United States Patent [19]

Schar et al.

[11] 4,186,008

[45] Jan. 29, 1980

[54] METHOD FOR PROCESSING SILVER DYE-BLEACH MATERIALS

[75] Inventors: Meinrad Schar; Matthias Schellenberg, both of Marly, Switzerland

[73] Assignee: Ciba-Geigy Aktiengesellschaft, Basel, Switzerland

[21] Appl. No.: 886,870

[22] Filed: Mar. 15, 1978

[30] Foreign Application Priority Data

Mar. 23, 1977 [CH] Switzerland ..... 3665/77

[51] Int. Cl.[2] ..... G03C 7/00

[52] U.S. Cl. ..... 430/393; 430/461; 430/462

[58] Field of Search ..... 96/53, 60 R

[56] References Cited

U.S. PATENT DOCUMENTS

| | | | |
|---|---|---|---|
| 3,259,497 | 7/1966 | Wartburg | 96/53 |
| 3,748,136 | 7/1973 | Willems | 96/60 R |
| 3,754,918 | 8/1973 | Hunig et al. | 96/53 |
| 3,961,957 | 6/1976 | Kramp et al. | 96/53 |
| 3,963,492 | 6/1976 | Marthaler et al. | 96/53 |
| 4,014,698 | 3/1977 | Marthaler | 96/53 |
| 4,070,188 | 1/1978 | Nakamura et al. | 96/53 |

*Primary Examiner*—Travis Brown

*Attorney, Agent, or Firm*—Sprung, Felfe, Horn, Lynch & Kramer

[57] ABSTRACT

A method for processing silver dye-bleach materials, with the process measures silver developing, dye bleaching, silver bleaching and fixing, wherein the silver and dye bleaching can be combined in a single treatment step is provided. For the silver bleaching or the combined dye and silver bleaching an acid formulation is used which has a pH value of at most 2 and contains a strong acid, a water-soluble iodide, optionally a water-soluble organic nitro compound, a non-quaternised quinoxaline or pyrazine, an anti-oxidant and at least one quaternary ammonium salt or a protonated tertiary organic nitrogen base. By this method the processing time can be shortened without impairing the quality of the colored images obtained.

21 Claims, No Drawings

METHOD FOR PROCESSING SILVER DYE-BLEACH MATERIALS

Methods for processing silver dye-bleach materials comprising the process measures (1) silver developing, (2) dye bleaching, (3) silver bleaching and (4) fixing have already been described in German Offenlegungsschriften Nos. 2,530,469 and 2,448,433, and in the last-mentioned publication in particular an embodiment suitable for rapid processing is indicated, in which the process measures dye bleaching (2) and silver bleaching (3) are combined in a single treatment step. The methods according to the two cited publications are already very suitable for the processing of silver dye-bleach materials. However, it has been found that a further shortening of the processing time, especially of the silver bleaching process step, is desirable.

German Offenlegungsschrift Nos. 2,547,720 describes a further development of the processing methods described for silver dye-bleach materials, with which a masking effect is produced on the one hand by a specific material build-up and on the other hand by the use of a solvent for the silver halide in the developing stage (1), which effect makes it possible to obtain a reproduction of coloured originals which is more true to nature. Especially in the case of this last-mentioned embodiment, the image silver can be obtained in a form in which it is difficult to oxidise, so that a prolonged time is required for silver bleaching. In some cases, a small residue of silver which cannot be bleached also remains behind and this emerges as a troublesome fog in the final coloured image.

Quaternary ammonium salts as bleaching accelerators for bleaching metallic silver in photographic materials are already known from U.S. Pat. No. 3,748,136. A prerequisite for acceleration of bleaching is the use of negatively charged oxidising agents (bleaching agents), for example persulphate, bichromate or the iron-III complex of ethylenediamine tetracarboxylic acid. With positively charged bleaching agents, for example Cu-II chloride or hexacyanoferrate(III), on the other hand, the same compounds display no accelerating action but can even act as bleaching inhibitors (c.f. J. Phot. Sci. 19, 113 (1971)).

It has now been found that the process measure of silver bleaching (3) can be considerably accelerated in the presence of positively charged bleaching agents also if at least one quaternary ammonium salt or a protonated tertiary nitrogen base is added to the formulations for silver bleaching and the bleaching agents are quinoxalines or pyrazines.

The present invention relates to a method for processing imagewise exposed silver dye-bleach materials, with the process measures (1) silver developing, (2) dye bleaching, (3) silver bleaching and (4) fixing, optionally process measure (3) can be combined with process measure (2) in a single treatment step, which method comprises employing for the silver bleaching (3) or the combined dye (2) and silver bleaching (3) an acid formulation which has a pH value of at most 2 and contains (a) a strong acid, (b) a water-soluble iodide, (c) optionally a water-soluble organic nitro compound, (d) a non-quaternised quinoxaline or pyrazine, (e) an anit-oxidant and (f) at least one quaternary ammonium salt of the formulae

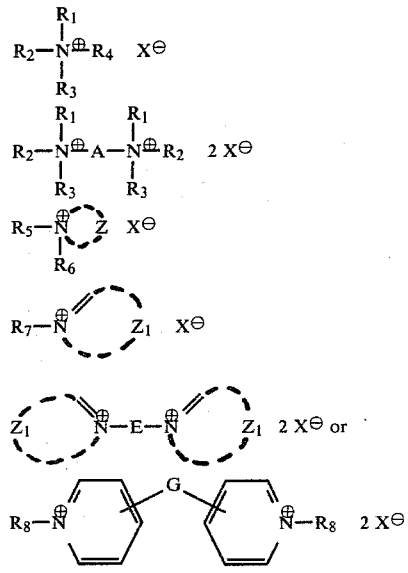

(1)

(2)

(3)

(4)

(5)

(6)

or a protonated tertiary organic nitrogen base of the formula

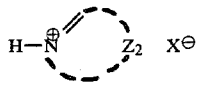

(7)

in which formulae $R_1$, $R_2$, $R_3$, $R_4$ and $R_5$ independently of one another are methyl or ethyl, $R_6$ is methyl or ethyl or $—CH_2CH_2—$, in which case this grouping is bonded to a further quaternary nitrogen atom of Z, Z is $—(CH_2)_5—$ or $$—(CH_2)_2\overset{|}{\underset{|}{N}}{}^{\oplus}—(CH_2)_2—,$$

$R_7$ is alkyl having 1 to 4 carbon atoms, unsubstituted or substituted aryl or hydroxyalkyl having 1 to 20 carbon atoms and $R_8$ is methyl or ethyl, or the two $R_8$'s together are alkylene having 2 to 4 carbon atoms if G is a direct bond, G is a direct bond or alkylene having 1 to 20 carbon atoms, $Z_1$ is the atoms necessary to form a pyridine, pyrazine or quinoline ring, which is unsubstituted or substituted by methyl, ethyl or hydroxyalkyl having 1 to 12 carbon atoms, and $Z_2$ is the atoms necessary to form a pyridine or quinoline ring, which is unsubstituted or substituted by methyl, ethyl or hydroxyalkyl having 1 to 12 carbon atoms, A and E are alkylene having 1 to 20 carbon atoms and $X^{\ominus}$ is a monovalent anion.

The present invention also relates to the formulations, for carrying out silver bleaching or the combined dye bleaching and silver bleaching, which contain components (a) to (f) or (a), (b) and (d) to (f), and to the photographic images obtained by the method according to the invention.

In general, the formulations which are required for processing are allowed to act, on the material, in the form of dilute aqueous solutions. However, other methods are also conceivable, for example use of the formulations in paste form. The temperature of the baths during processing, and especially that of the silver-bleaching bath (3) or of the combined dye-bleaching and silver-bleaching bath [(2)+(3)], can generally be between 20° and 90° C., preferably between 20° and 60° C., the requisite processing time being, of course, shorter at a higher temperature than at a lower temperature.

The bleaching formulation according to the invention can be prepared in the form of a liquid concentrate and, because of its good stability, be stored for a long time.

Advantageously, for example, two liquid, especially aqueous, concentrates are used, one of which contains the strong acid (a) and, if desired, the organic nitro compound (c) and the other of which contains the remaining components (b), (d), (e) and (f), it being possible to add an additional solvent, such as ethyl alcohol or propyl alcohol, ethylene glycol monomethyl ether or ethylene glycol monoethyl ether, to the latter concentrate in order to improve the solubility, especially of component (d).

The dilute formulations which are suitable for processing are obtained by adding these concentrates together and diluting with water and, if desired, organic solvents, for example the said solvents.

Baths of conventional composition can be used for the silver developing (1), for example those which contain hydroquinone as the developer substance and, if desired, additionally also contain 1-phenyl-3-pyrazolidinone. Moreover, it is advantageous when the silver developing bath, as described in Swiss Patent Specification No. 405,929, additionally also contains a dye-bleach catalyst.

If dye bleaching is to be carried out as a separate treatment step, the dye-bleaching baths (2) used are advantageously those which contain a dye-bleach catalyst, in addition to a strong acid, a water-soluble iodide and an antioxidant for the iodide. Suitable dye-bleach catalysts are described, for example, in German Auslegeschriften Nos. 2,010,280, 2,144,298 and 2,144,297, in French Patent Specification No. 1,489,460, in U.S. Pat. No. 2,270,118 and in German Offenlegungsschrift No. 2,448,443.

The silver-fixing bath (4) can be of a known and conventional composition. A suitable fixing agent is, for example, sodium thiosulphate or advantageously ammonium thiosulphate, optionally with additives such as sodium bisulphite and/or sodium metabisulphite.

As a constituent of the silver-bleaching bath (3) or of the combined dye-bleaching (2) and silver-bleaching (3) bath, the strong acids (a) should impart a pH value of at most 2 to the silver-bleaching bath (3); acids which can be used are therefore in particular sulphuric acid or sulphamic acid. However, other strong acids, such as phosphoric acid, can also be used.

The water-soluble iodide (b) used is, for example, potassium iodide or sodium iodide. The amount of iodide is advantageously 2 to 50 g per litre of formulation.

Compounds which can be employed as the water-soluble organic nitro compound (c), which is to be used if desired, are, advantageously in amounts of 1 to 30 g per litre, water-soluble aromatic nitro compounds, preferably aromatic mono- or dinitrobenzenesulphonic acids, for example those of the formula

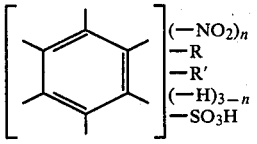

in which n is 1 or 2 and R and R' are hydrogen, lower alkyl, alkoxy, amino or halogen. The sulphonic acids can be added in the form of readily soluble salts. For example, the sodium or potassium salts of the following acids are suitable: o-nitrobenzenesulphonic acid, m-nitrobenzenesulphonic acid, 2,4-dinitrobenzenesulphonic acid, 3,5-dinitrobenzenesulphonic acid, 3-nitro-4-chlorobenzenesulphonic acid, 2-chloro-5-nitrobenzenesulphonic acid, 4-methyl-3,5-dinitronbenzenesulphonic acid, 3-chloro-2,5-dinitrobenzenesulphonic acid, 2-amino-4-nitrobenzenesulphonic acid and 2-amino-4-nitro-5-methoxybenzenesulphonic acid.

The compounds of component (c) serve to level off the gradation.

Compounds which can be used as the non-quaternised quinoxalines or pyrazines of component (d) are in particular water-soluble pyrazine or quinoxaline compounds with an absorption maximum of less than 450 nm.

Suitable quinoxalines are in particular those which are substituted in the 2-, 3-, 5-, 6- or 7-position by methyl groups, methoxy groups or acylated or non-acylated hydroxymethyl groups or by acylated or non-acylated amino groups. The Table which follows gives a selection of suitable bleaching catalysts.

Quinoxaline compounds of the formula

Table I

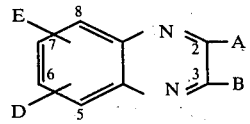

(9)

(Ac is —CO—CH3)

| A | B | D | E |
|---|---|---|---|
| —CH3 | —CH(OH)—CH3 | —H | —H |
| —CH2OH | —CH2OH | 6-OCH3 | 7-NH—CO—CH3 |
| —CH2OAc | —CH2OAc | 6-OCH3 | 7-NH—CO—CH3 |
| —CH2Cl | —CH2Cl | 6-OH | —H |
| —CH2OH | —CH2OH | 6-OCH3 | 7-NH2 |
| —CH2OH | —CH2OH | 5-OCH3 | 6-Cl |
| —CH2OH | —CH2OH | 5-Cl | 6-OCH3 |
| —CH2O Ac | —CH2OAc | 5-OCH3 | 6-OCH3 |
| —CH2OAc | —CH2OAc | 5-Cl | 6-OCH3 |
| —CH3 | —CH3 | 5,6-O—CH2—O— | |
| —CH2OH | —CH2OH | 6,7-O—CH2—CH2—O | |

Table I-continued (9)

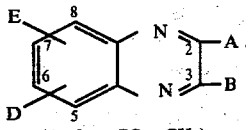

(Ac is —CO—$CH_3$)

| A | B | D | E |
|---|---|---|---|
| —$CH_2$—$OC_2H_5$ | —$CH_2OC_2H_5$ | 6-$OCH_3$ | —H |
| —$CH_2$—$OCH_3$ | —$CH_2$—$OCH_3$ | —H | —H |
| —$CH_2OH$ | —$CH_2OH$ | 5-$OCH_3$ | —H |
| —$CH_2OH$ | —$CH_2OH$ | 6-$OCH_3$ | —H |
| —$CH_2OH$ | —$CH_2OH$ | 6-$OCH_3$ | 7-$OCH_3$ |
| —$CH_2OH$ | —$CH_2OH$ | —H | —H |
| —$CH_2OAc$ | —$CH_2OAc$ | 5-$OCH_3$ | —H |
| —$CH_2OAc$ | —$CH_2OAc$ | 6-$OCH_3$ | —H |
| —$CH_2OAc$ | —$CH_2OAc$ | 6-$OCH_3$ | 7-$OCH_3$ |
| —$C_6H_5$ | —$C_6H_5$ | 6-$SO_3H$ | —H |
| —$CH_3$ | —$CH_3$ | 5-$CH_3O$ | 8-$CH_3$ |
| —$CH_2OAc$ | —$CH_2OAc$ | —H | —H |
| —$CH_3$ | —$CH_3$ | 6,7-O—$CH_2$—$CH_2$—O— | |
| —$CH_2OH$ | —$CH_2OH$ | 6,7-O—$CH_2$—O— | |
| —$CH_3$ | —$CH_3$ | —$CH_3$ | —$CH_3$ |
| —$CH_3$ | —$CH_3$ | 6-Cl | —H |
| —$CH_3$ | —$CH_3$ | 5-OH | —H |
| —$CH_3$ | —$CH_3$ | 5-OH | 8-OH |
| —$CH_2OAc$ | —$CH_2OAc$ | 6,7-O—$CH_2$—$CH_2$—O— | |
| —$CH_2OAc$ | —$CH_2OAc$ | 6,7-O—$CH_2$—O— | |
| —$CH_3$ | —$CH_3$ | 6-COOH | —H |
| —$CH_3$ | —$CH_3$ | 5-$OCH_3$ | 8-$OCH_3$ |
| —$CH_3$ | —$CH_3$ | —H | —H |
| —$CH_3$ | —$CH_3$ | —$CH_3$ | —H |
| —$CH_3$ | —$CH_3$ | 6-$OCH_3$ | —H |
| —$CH_3$ | —$CH_3$ | 6-OH | —H |
| —$CH_3$ | —$CH_3$ | 6-$SO_3H$ | —H |

Pyrazines, such as pyrazine itself or pyrazines substituted by methyl, ethyl and/or carboxylic acid groups, such as 2-methylpyrazine, 2-ethylpyrazine, 2,3-, 2,5- or 2,6-dimethylpyrazine, pyrazinecarboxylic acid, pyrazine-2,3-, -2,5- or -2,6-dicarboxylic acid or 2,3-dimethylpyrazine-5,6-dicarboxylic acid, can also be used as dye-bleach catalysts.

Very suitable dye-bleach catalysts are water-soluble quinoxalines containing the following substituents:

(a) A hydroxymethyl group in the 2-position and in the 3-position and, as further substituents, 6-methoxy, 6,7-dimethoxy, 6-methoxy-7-acetylamino, [4,5-g]-1,3-dioxolo or [2,3-g]-1,4-dioxano, (b) An acylated hydroxymethyl group in the 2-position and in the 3-position and, as further substituents, 6,7-dimethoxy, 6-methoxy-7-acetylamino, 5-methoxy-6-chloro, 6-methoxy-5-chloro or [4,5-g]-1,3-dioxolo or 2,3-g]-1,4-dioxano, (c) A methyl group in the 2-position and in the 3-position and no further substituents or, as further substituents: monomethoxy or dimethoxy, methyl, 6-chloro,5-hydroxy or 5,8-dihydroxy, 6-hydroxy, [4,5-f]-1,3-dioxolo or [2,3-g]-1,4-dioxano or (d) A phenyl group in the 2-position and in the 3-position and a sulphonic acid group in the 6-position.

Quinoxalines containing the following substituents are preferred:

(a) A hydroxymethyl group in the 2-position and in the 3-position and, as further substituents, 6-methoxy, 6,7-dimethoxy, [4,5-g]-1,3-dioxolo or [2,3-g]-1,4-dioxano, (b) An acylated hydromethyl group in the 2-position and in the 3-position and a methoxy group in the 6-position and in the 7-position, or (c) A methyl group in the 2-position and in the 3-position and no further substituents or, as further substituents: methyl, 6-hydroxy or 5,8-dihydroxy.

Useful dye-bleach catalysts are also described in German Auslegeschriften Nos. 2,010,707, 2,144,298 and 2,144,297, in French Patent Specification No. 1,489,460 and in U.S. Pat. No. 2,270,118.

Compounds used as the antioxidant of component (e) are advantageously reductones or water-soluble mercapto compounds.

Suitable reductones are in particular aci-reductones containing a 3-carbonyl-1,2-enediol grouping, such as reductine, triose-reductone or preferably ascorbic acid.

Mercapto compounds which can be used are those of the formula $$HS—A—(B)_m \quad (10)$$

in which A is an aliphatic, cycloaliphatic, araliphatic, aromatic or heterocyclic bridge member, B is a radical conferring solubility in water and m is an integer of at most 4.

Particularly advantageous compounds are those of the formulae $$HS—C_qH_{2q}—B \quad (11)$$

or $$HS—(CH_2)_m—COOH \quad (12)$$

in which q is an integer with a value of 2 to 12, B is a sulphonic acid group or carboxylic acid group and m is one of the numbers 3 and 4. Mercapto compounds which can be used as antioxidants are described, for example, in German Offenlegungsschrift No. 2,258,076 and in German Offenlegungsschrift No. 2,423,814. The mercapto compounds, especially those of the above formula (12), i.e. ω-mercaptobutyric acid and ω-mercaptocaproic acid, not only provide good protection against oxidation but in some cases even have a pronounced anticorrosive action. In general, when choosing the oxidising agent (c) and the antioxidant (e) care must be taken to ensure that the latter are not oxidised to a substantial extent by the former.

In the formulae (1) and (2) of the quaternary ammonium salts, the substituents $R_1$, $R_2$, $R_3$ and $R_4$ independently of one another are methyl or ethyl. The compounds of the formulae (1) and (2) can thus contain methyl or ethyl substituents or both methyl and ethyl substituents. The bridge member A in the compounds of the formula (2) is alkylene having 1 to 20 carbon atoms, especially having 2 to 12 and preferably having 2 to 6 carbon atoms. Examples of these bridge members are $—CH_2—$, $—(CH_2)_2—$, $—(CH_2)_3$, $—(CH_2)_4—$, $—(CH_2)_6—$, $—(CH_2)_{10}—$, $—(CH_2)_{12}—$ and $—(CH_2)_{20}—$.

The compounds of the formula (3) are quaternary piperidine or piperazine compounds which can have the following structures:

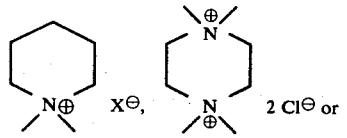

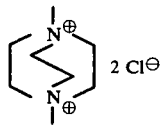

The substituents on the nitrogen atom or atoms are lower alkyl, especially methyl and ethyl.

The compounds of the formula (4) have, as the basic structure, a pyridine, pyrazine or quinoline ring, which is quaternised at the nitrogen atom or atoms.

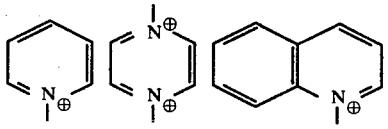

The substituents on the nitrogen atoms are alkyl having 1 to 4 carbon atoms, for example methyl, ethyl, propyl, butyl and the corresponding isomers, hydroxyalkyl, especially ω-hydroxyalkyl having 1 to 20 carbon atoms, for example $—CH_2OH$, $—(CH_2)_2OH$, $—(CH_2)_3OH$, $—(CH_2)_4OH$, $—(CH_2)_{10}OH$ or $—(CH_2)_{12}OH$ and also aryl, which is unsubstituted, such as phenyl, naphthyl or anthryl, or substituted, for example

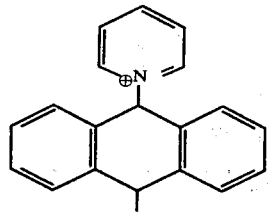

The substituents $R_7$ on the aromatic rings of the formula (4) can be methyl or ethyl or hydroxyalkyl having 1 to 12 carbon atoms, ω-hydroxyalkyl being preferred, for example $—CH_2OH$, $—(CH_2)_2OH$, $—(CH_2)_3OH$, $—(CH_2)_4OH$, $—(CH_2)_6OH$ or $—(CH_2)_{12}OH$.

The compounds of the formula (5) have the same basic structure in the aromatic-heterocyclic rings, and the same substituents on the rings, as the compounds of the formula (4). The bridge member E is alkylene and can contain 1 to 20, preferably 2 to 12, carbon atoms, especially $—(CH_2)_2—$, $—(CH_2)_3—$, $—(CH_2)_4—$, $—(CH_2)_6—$ or $—(CH_2)_{12}—$.

In the compounds of the formula (6), the substituents on the nitrogen atoms are methyl or ethyl and G is a direct bond or alkylene having 1 to 20 carbon atoms. If G is a direct bond, the two substituents on the nitrogen atom together (alkylene having 2 to 4 carbon atoms) can form a further heterocyclic ring, for example

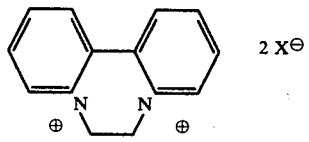

(13)

or

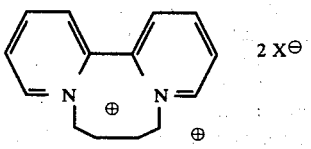

(14)

The protonated tertiary organic nitrogen bases of the formula (7) are preferably protonated pyridine or quinoline derivatives, which can be substituted by methyl or ethyl or ω-hydroxyalkyl having 1 to 12 carbon atoms. The protonated pyridine or quinoline derivatives can contain one or more substituents. The protonation of these compounds is as a rule effected in the strongly acid bleaching bath, which has a pH value of at most 2 and preferably of at most 1.

$X^{\ominus}$ is a monovalent anion, for example a halide ion (chloride, bromide or iodide ion) and also tetrafluoborate, hydrogen sulphate, toluenesulphonate or fluorosulphate. The halide ions are preferred.

The compounds of the formulae (1) to (7) are known chemical compounds which can be prepared by simple chemical reactions known to those skilled in the art.

Preferred quaternary ammonium salts of component (f) have the formulae

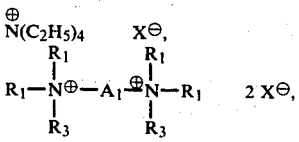

(15)
(16)

-continued (17)

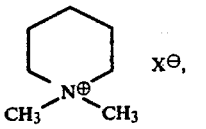

$X^{\ominus}$, (18)

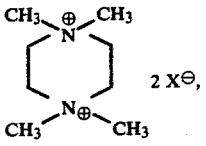

$2\ X^{\ominus}$, (19)

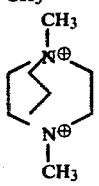

$2\ X^{\ominus}$ (20)

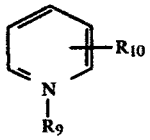

$X^{\ominus}$, (21)

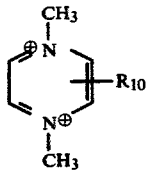

$2\ X^{\ominus}$, (22)

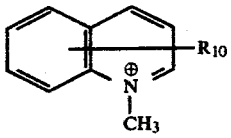

$X^{\ominus}$, (23)

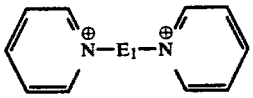

$2\ X^{\ominus}$, (24)

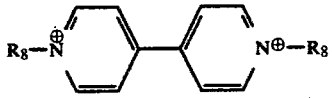

or (25)

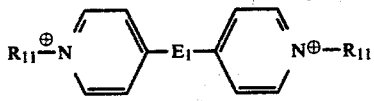

$2\ X^{\ominus}$ and the protonated tertiary nitrogen base is a compound of the formula (26)

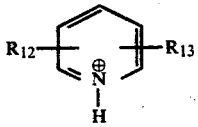

$X_1^{\ominus}$ in which formulae $R_1$ and $R_3$ are methyl or ethyl, $R_8$ is methyl or ethyl, or the two $R_8$'s together are $-(CH_2)_n-$, in which n is 2 to 4, $R_9$ is methyl, ethyl, substituted or unsubstituted aryl or ω-hydroxyalkyl having 1 to 12 carbon atoms, $R_{10}$ is hydrogen, methyl, ethyl, hydroxymethyl or hydroxyethyl, $R_{11}$ is methyl or ethyl, $R_{12}$ and $R_{13}$ are hydrogen, methyl, ethyl or hydroxyalkyl having 1 to 12 carbon atoms, hydrogen and methyl being preferred, $A_1$ and $E_1$ are alkylene having 2 to 12 carbon atoms and $X^{\ominus}$ and $X_1^{\ominus}$ are a monovalent anion.

Particularly valuable compounds of component (f) are those of the formulae (27)

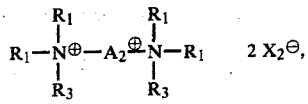

$2\ X_2^{\ominus}$, (28)

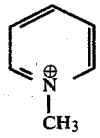

$X_2^{\oplus}$, (29)

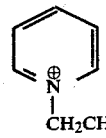

$X_2^{\oplus}$ or (30)

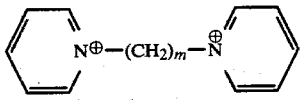

in which formulae $A_2$ is alkylene having 2 to 6 carbon atoms, R and $R_3$ are methyl or ethyl, $X_2^{\ominus}$ is a chloride, bromide or iodide ion and m is an integer from 2 to 12.

The pH value of the bleaching bath should be less than 2 and this can be achieved without difficulty by the presence of sulphuric acid or sulphamic acid, which have already been mentioned. The temperature of the bleaching bath, and also of the other treatment baths, is 20° to 90° C. In general it is advantageous not to exceed 60° C., for example to work at 30° to 40° C. It is, however, a further advantage of the process that it gives good images of normal colour balance at elevated temperature, for example at 50° C. or even higher. As a result of the increase in the temperature, processing can be further shortened and even under these conditions the baths still remain stable for an adequately long time. The quantity ratios of the substances (a), (b), (c), (d), (e) and (f) present in the bleaching bath can vary within fairly wide limits. It is advantageous when the bleaching baths for carrying out the method according to the invention contain (a) a strong acid which provides a pH value of at most 2 in the formulation, (b) 2 to 50 g/l of a water-soluble iodide, (c) optionally, 1 to 30 g/l of a water-soluble organic nitro compound, (d) 0.2 to 5 g/l of a non-quaternised quinoxaline or pyrazine, (e) 0.5 to 10 g/l of an antioxidant and (f) 0.5 to 30 g/l of a quaternary ammonium salt or of a protonated tertiary organic nitrogen base.

The concentrates of the individual components or their combinations, for example of component (a) and, optionally, (c) and also of components (b), (d), (e) and (f), can contain, per liter of concentrated formulation, 4 to 25 times, preferably 5 to 10 times, the amount of the individual components which has been indicated above for the ready-to-use bleaching baths. As a rule, the concentrates are in liquid or paste form.

The repetition of individual treatments (in each case in a further tank with a bath of the same composition as the preceding bath) within the given time limits is possible and in some cases better utilisation of the bath can be achieved in this way. If the number of available tanks and the time programme allow, water baths can also be interposed between baths having different actions. However, the material is usually advantageously brought from the silver developing bath (1) directly into the bleaching bath (dye-bleaching bath and silver-bleaching bath), which can be combined, in particular when the silver developing bath already contains dye-bleach catalyst.

All of the baths can contain additives, for example hardeners, wetting agents, fluorescent brighteners and UV stabilisers.

The method according to the invention can be used, for example, in the production of positive coloured images using dish or drum processing, in automatic copying or recording machines or in the rapid processing of other silver dye-bleach materials, for example for scientific recording and industrial purposes, for example coloured photofluorography.

The silver dye-bleach material used can be a transparent, metallically reflecting or preferably white-opaque material, the base of which is not able to absorb any liquid from the bath.

The base can consist, for example, of cellulose triacetate or polyester, which can be pigmented. If it consists of paper felts, these must be lacquer-coated, or coated with polyethylene, on both sides. The light-sensitive layers are located on at least one side of this base, preferably in the known arrangement, i.e. at the bottom a red-sensitised silver halide emulsion layer, which contains a cyan azo dye, above this a green-sensitised silver halide emulsion layer, which contains a magenta azo dye, and at the top a blue-sensitive silver halide emulsion layer, which contains a yellow azo dye. The material can also contain subbing layers, intermediate layers, filter layers and protective layers. In particular, it is also possible, as has been described in German Offenlegungsschriften Nos. 2,036,918, 2,132,835 and 2,132,836, for the silver halide emulsion and the bleachable dye assigned thereto to be contained in two or three separate layers adjacent to one another but the total thickness of the layers should as a rule not exceed 20$\mu$.

The advantages of the method according to the invention lie in the fact that even image silver which is difficult to bleach can be completely oxidised or rehalogenated within a short time.

If dye-bleaching and silver-bleaching are carried out in a combined bleaching bath, it is found that dye-bleaching is also accelerated and no undesired shift between the two competing bleaching actions arises.

Furthermore, it has been found that the subsequent process measure of fixing (4), in which the silver halide which has not been developed and also the fresh silver halide formed during bleaching are dissolved by a complexing agent, is likewise facilitated or accelerated by the preceding treatment with a bleaching bath according to the invention.

In the Examples which follow, parts and percentages are by weight unless otherwise stated.

The quaternary ammonium compounds and protonated tertiary bases referred to in the Examples are given in Table II.

Table II $(H_3C)_3\overset{\oplus}{N}-CH_2CH_2-\overset{\oplus}{N}(CH_3)_3 \quad 2\,I^{\ominus}$ (101)

$(H_3C)_3\overset{\oplus}{N}-(CH_2)_6-\overset{\oplus}{N}(CH_3)_3 \quad 2\,I^{\ominus}$ (102)

Table II-continued $(H_3C)_2\overset{\oplus}{N}(C_2H_5)-CH_2CH_2-\overset{\oplus}{N}(C_2H_5)(CH_3)_2 \quad 2I^{\ominus}$ (103)

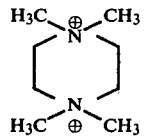
(104)

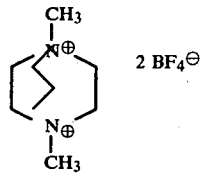
(105)

$N^{\oplus}(C_2H_5)_4 \quad I^{\ominus}$ (106)

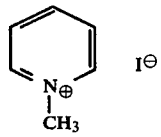
(107)

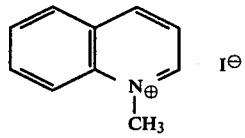
(108)

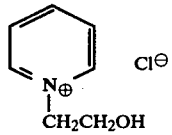
(109)

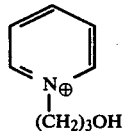
(110)

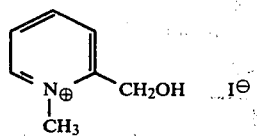
(111)

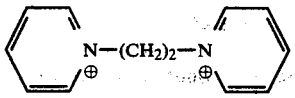
(112)

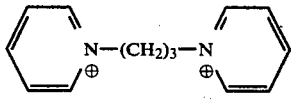
(113)

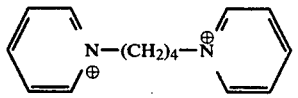
(114)

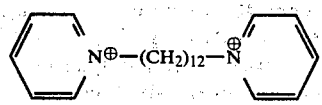
(115)

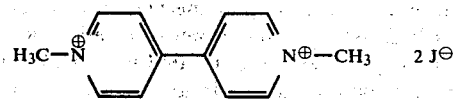
(116)

Table II-continued (117)

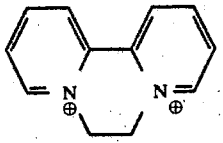

2 Br⊖

(118)

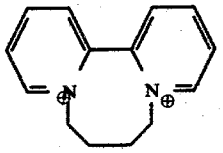

2 Br⊖

(119)

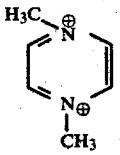

$FSO_3^{\ominus}$

The compounds of the formulae (101) to (103), (107) and (109) to (115) are particularly preferred.

(120)

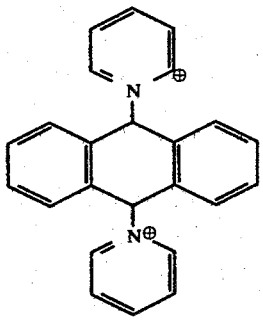

2 Br⊖

-continued (121)

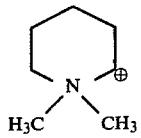

$J^{\ominus}$ (122)

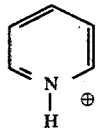

$HSO_4^{\ominus}$ (123)

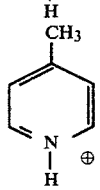

$HSO_4^{\ominus}$ (124)

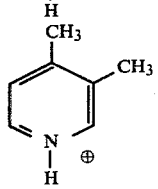

$HSO_4^{\ominus}$ (125)

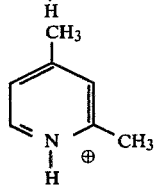

$HSO_4^{\ominus}$

EXAMPLE 1

A photographic material for the silver dye-bleach process is prepared on a pigmented cellulose acetate base using the cyan image dye of the formula (126)

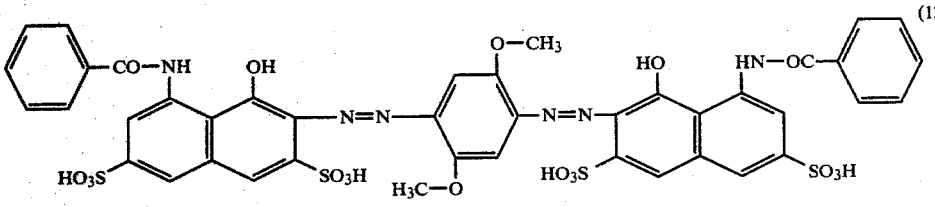

in the red-sensitised bottommost layer, the magenta dye of the formula (127)

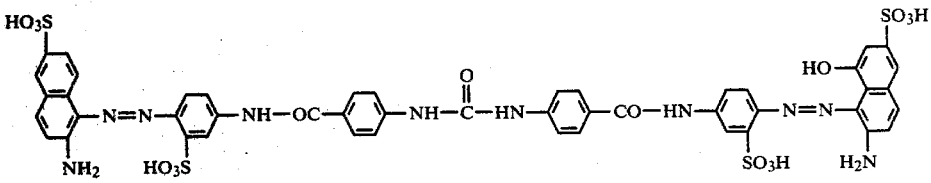

in a green-sensitised layer above this and the yellow dye of the formula

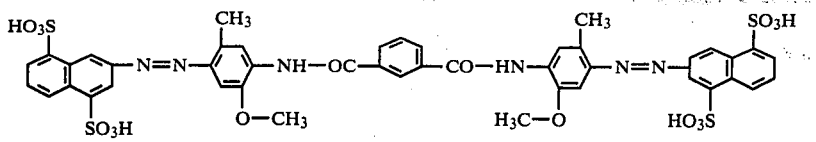

(128)

in a blue-sensitive layer which is located above the magenta layer.

The photographic material used is built up as follows:

| |
|---|
| Gelatine protective layer |
| Blue-sensitive, iodide-free AgBr emulsion |
| Yellow dye (128) + blue-sensitive, iodide-free AgBr emulsion |
| Yellow filter: yellow Ag hydrosol (40 mg/m$^2$) |
| Green-sensitive AgBr/AgI emulsion |
| Magenta dye (127) + green-sensitive AgBr/AgI emulsion |
| Intermediate layer (gelatine) |
| Cyan dye (126) + red-sensitive AgBr/AgI emulsion |
| Red-sensitive AgBr/AgI emulsion |
| White opaque cellulose triacetate base |
| Gelatine backing |

The layers of emulsion which contain iodide contain crystals with 2.6 mol % of silver iodide and 97.4 mol % of silver bromide. The image dyes are used in a concentration such that their reflectance density is 2.0 in each case; the total silver content of the 22$\mu$ thick material is 2.0 g/m$^2$.

This material is exposed to white light for 150 Lux-seconds and then developed at 24° C. for 2 minutes in a uniformly agitated developer of the composition given below, washed for 2 minutes and dried.

| | | | |
|---|---|---|---|
| Developer: | sodium polyphosphate | 1 | (g/liter) |
| | potassium metabisulphite | 18 | |
| | ascorbic acid | 10 | |
| | benztriazole | 0.2 | |
| | potassium bromide | 2 | |
| | boric acid | 16 | |
| | potassium hydroxide | 27 | |
| | 1-phenyl-3-pyrazolidinone | 2 | |
| | hydroquinone | 12 | |

Pieces of the developed material are then bleached for 2½ minutes or 3½ minutes in the bleaching bath (combined silver-bleaching and dye-bleaching) of the composition given below, at 24° C. and with accurately constant agitation of the bath, fixed for 5 minutes, washed and dried.

| | | | |
|---|---|---|---|
| Bleaching bath: | sulphamic acid | 140 | (g/liter) |
| | m-nitrobenzenesulphonic acid (sodium salt) | 6 | |
| | 2,3,6-trimethyl-quinoxaline | 2 | |
| | potassium iodide | 6 | |
| | ascorbic acid | 2 | |
| | quaternised/protonated compounds added | 0.5–22 | |
| | pH value of the bleaching bath: | about 0.5 | |
| Fixing bath: | $(NH_4)_2S_2O_3$ | 220 | (g/liter) |
| | $Na_2S_2O_5$ (sodium meta-bisulphite) | 10 | |
| | $Na_2SO_3$ | 40 | |

Table III summarises the reflectance densities (grey) of the processed samples:

Table III

| Additive to the bleaching bath Compound of the formula | g/l | Reflectance density 2½ minutes bleaching time | 3½ minutes bleaching time |
|---|---|---|---|
| without additive | — | 0.94 | 0.56 |
| 101 | 12 | 0.02 | 0.01 |
| 102 | 13 | 0.02 | 0.00 |
| 103 | 14 | 0.49 | 0.07 |
| 104 | 11 | 0.01 | 0.02 |
| 105 | 1.5 | 0.12 | 0.04 |
| 106 | 19 | 0.01 | 0.00 |
| 107 | 3 | 0.02 | 0.02 |
| 108 | 1 | 0.10 | 0.02 |
| 109 | 2.5 | 0.06 | 0.02 |
| 110 | 3 | 0.02 | 0.00 |
| 111 | 2 | 0.02 | 0.01 |
| 112 | 1.5 | 0.10 | 0.02 |
| 113 | 1.5 | 0.01 | 0.01 |
| 114 | 1.5 | 0.04 | 0.01 |
| 115 | 2 | 0.01 | 0.00 |
| 116 | 0.5 | 0.24 | 0.03 |
| 117 | 1 | 0.12 | 0.03 |
| 118 | 1 | 0.10 | 0.02 |
| 119 | 13 | 0.03 | 0.02 |
| 120 | 7 | 0.06 | 0.02 |
| 121 | 9 | 0.13 | 0.06 |
| 122 | 22 | 0.24 | 0.10 |
| 123 | 3 | 0.12 | 0.04 |
| 124 | 3 | 0.22 | 0.10 |
| 125 | 3 | 0.49 | 0.31 |

The results show that the residual density of the samples, which is due solely to metallic silver which has not been bleached, decreases very much more rapidly when the quaternised or protonated compounds are used in the bleaching bath. The amounts indicated are as a rule optimum values, i.e. the bleaching action becomes less both when the amounts are reduced and when the amounts are increased.

EXAMPLE 2

Photographic material according to Example 1 is used and exposure is also carried out as indicated in that example. Processing is carried out in accordance with the following instructions:

| | | | |
|---|---|---|---|
| 1. Developing: | 2 minutes | Composition as in Example 1 | |
| 2. Bleaching: | 4 minutes | Composition as in Example 1 | |
| 3. Fixing: | 2 minutes | | |
| | The disodium salt of ethylene-diaminetetraacetic acid | | 2 (g/litre) |
| | $(NH_4)_2S_2O_3$ | | 200 |
| | $K_2S_2O_5$ | | 50 |
| | KOH | | 17 |
| 4. Washing | 5 minutes | | |

After drying, the residual silver content is determined by X-ray fluorimetry. Table IV shows the influence of a quaternary ammonium salt in the bleaching bath on the fixing speed:

Table IV

| | Additive to the bleaching bath | Additive to the fixing bath | Ag mg/m² |
|---|---|---|---|
| 1 | without | without | 16 |
| 2 | 2.5 g/liter of the compound of the formula (108) | without | 5 |
| 3 | 2.5 g/liter of the compound of the formula (108) | 2.5 g/liter of the compound of the formula (108) | 4 |
| 4 | without | 80 ml/liter of N-methylpyrrolidone (fixing accelerator, comparison) | 5 |

The processed sample is not pure white but has a distinctly visible yellow fog, which is due to the AgI which has not been fully fixed.

The results show that full fixing of the silver iodide from the gelatine layers proceeds at an accelerated speed when the bleaching bath contains an ammonium compound according to the present invention. The addition of such an ammonium compound to the fixing bath does not result in any significant acceleration of the fixing process. The fixing speed is comparable to that which is achieved, after a bleaching bath treatment (without the accelerator additive), in a fixing bath with a conventional fixing accelerator (8% by volume N-methylpyrrolidone).

EXAMPLE 3

A photographic material with three colour layers, for the silver dye-bleach process, is prepared on a pigmented cellulose acetate base; the material contains the cyan image dye of the formula (126) in the bottommost red-sensitive layer, the magenta image dye of the formula (127) in the green-sensitive layer above this and the yellow image dye of the formula (128) in the uppermost blue-sensitive layer.

The image dyes are incorporated in the emulsions in a reflectance density of D=2.0. The colour layers with a total of 2.0 g of Ag/m² are separated by gelatine layers and the total layer thickness is 22μ.

Four identical strips are exposed behind a step wedge using blue, green and red light; the strips are designated A to D and are processed together in accordance with the following instructions. In the silver-bleaching bath, strips A to D are each treated separately. The temperature of the baths is always 24° C.

1. Silver developing: 6 minutes
   Sodium polyphosphate: 1 g/l
   anhydrous sodium sulphite: 50 g/l
   hydroquinone: 5 g/l
   sodium metaborate: 15 g/l
   1-phenyl-3-pyrazolidinone: 0.3 g/l
   potassium bromide: 3 g/l
   benztriazole: 0.2 g/l
   water to make up to 1 l
2. Washing: 5 minutes
3. Dye-bleaching: 7 minutes
   Water: 800 ml
   sulphuric acid (96%): 14 ml
   ascorbic acid: 1 g
   potassium iodide: 30 g
   2,3-dimethyl-5-amino-6-methoxyquinoxaline 0.08 g
   water to make up to 1,000 ml
4. Washing: ½ minute Strips A and B are treated in a silver-bleaching bath of the composition given below, strip A being treated for 1½ minutes and strip B being treated for 3 minutes.

The same silver-bleaching bath is used for strips C and D but 2.5 g per liter of the compound of the formula (109) are added to the bath; strip C is treated for 1½ minutes and strip D is treated for 3 minutes.

5. Silver-bleaching: 1½ and 3 minutes respectively
   Water: 865 ml
   sulphuric acid (96%): 20 ml
   the sodium salt of 2,4-dinitrobenzenesulphonic acid: 30 g
   ethylene glycol monoethyl ether: 60 ml
   2,3,6-trimethylquinoxaline: 2 g
   glacial acetic acid: 2 ml
   4-mercaptobutyric acid: 1 ml
   potassium iodide: 4 g
   water to make up to: 1,000 ml The further treatment of strips A to D in the solutions which follow is again carried out on all the strips together.

6. Washing: 2 minutes
7. Fixing: 4 minutes
   Bath composition as in Example 1
8. Washing: 6 minutes After drying, the minimum densities for blue light (optimum value: 0.05) are determined for all four strips A to D in a densitometer.

The following values are obtained:

| | $D_{minimum}$ (blue) |
|---|---|
| Strip A | 0.35 |
| Strip B | 0.10 |
| Strip C | 0.05 |
| Strip D | 0.05 |

By adding 2.5 g of the compound of the formula (109) per liter of bleaching bath, full silver-bleaching (strip C) is already achieved after 1½ minutes, whilst without this addition a substantial residual silver content (strip A) remains after a bleaching time of 1½ minutes and a small residual silver content (strip B) still remains even after a bleaching time of 3 minutes.

EXAMPLE 4

Photographic material according to Example 1 is used and exposure is also carried out as indicated in that example.

TABLE V

| No. | Difference from the bleaching bath composition according to Example 1 | Addition of a quaternary compound (bleaching bath) | Bleaching time 24° C. | Reflectance density (grey) | Ag (g/m²) | Residual silver content in % of the maximum amount of Ag which can be developed |
|---|---|---|---|---|---|---|
| 1 | without m-nitro-benzenesulphonic acid (sodium salt) | without | 7 minutes | 0.79* | 0.210 | 14.7 |
| 2 | without m-nitro- | 2.5 g/l of the | 7 minutes | 0.10* | 0.010 | 0.7 |

TABLE V-continued

| No. | Difference from the bleaching bath composition according to Example 1 | Addition of a quaternary compound (bleaching bath) | Bleaching time 24° C. | Reflectance density (grey) | Ag (g/m²) | Residual silver content in % of the maximum amount of Ag which can be developed |
|---|---|---|---|---|---|---|
| | benzenesulphonic acid (sodium salt) | compound of the formula (109) | | | | |
| 3 | without 2,3,6-trimethylquinoxaline | without | 4 minutes | 2.37** | 1.200 | 84.2 |
| 4 | without 2,3,6-trimethylquinoxaline | 2.5 g/l of the compound of the formula (109) | 4 minutes | 2.29** | 1.159 | 81.3 |
| 5 | without 2,3,6-trimethylquinoxaline | 2.5 g/l of the compound of the formula (109) | 7 minutes | 2.25** | 0.947 | 66.4 |
| 6 | Comparison sample (only developed and fixed) | | — | 2.30** | 1.426*** | — |

*Samples still contain silver only and no further dyes
**Sum of dyes and silver
***Maximum amount of silver which can be developed Experiment 6 (comparison sample) indicates the amount of silver which can be developed under the chosen conditions. The bleaching bath of experiment (1) contains no m-nitrobenzenesulphonate. Nevertheless, about 85% of the silver is converted in this solution within 7 minutes, 2,3,6-trimethylquinoxaline acting as an oxidising agent for the excess Ag. The addition of the compound of the formula (109) (experiment 2) raises the Ag conversion in 7 minutes to above 99%.

Experiments 3 to 5 were carried out without quinoxaline. They show that the conversion of silver is much slower with m-nitrobenzenesulphonate than with the substituted quinoxaline and, in addition, is hardly accelerated by the compound of the formula (109).

This example clearly shows that the 2,3,6-trimethylquinoxaline used, which has a pK value of 2.41 and therefore is present as a protonated cation at the pH of ~0.5 of the bleaching solution, acts as an oxidising agent for silver and that this reaction is accelerated by the ammonium salts used according to the invention. The action of the nitro compound is essentially the slow reoxidation of the reduced forms of the quinoxaline which are formed during silver-bleaching.

EXAMPLE 5

Photographic material according to Example 1 is used and exposure is also carried out as indicated in that example. Processing is carried out at 30° C. in accordance with the following instructions:

1. Developing: 3 minutes

| | | |
|---|---|---|
| Sodium polyphosphate | 1 | (g/liter) |
| potassium metabisulphite | 18 | |
| 85% potassium hydroxide | 27 | |
| boric acid | 21 | |
| 1-phenyl-3-pyrazolidinone | 0.3 | |
| hydroquinone | 5 | |
| ascorbic acid | 10 | |
| benztriazole | 0.6 | |
| potassium bromide | 2 | |
| anhydrous sodium thiosulphate | 1.3 | |

2. Bleaching: 2 minutes
   Composition as in Example 1.
3. Fixing: 3 minutes
   Composition as in Example 1.

After the samples have been subjected to final washing for 5 minutes and dried, the following amounts of residual silver were determined by X-ray fluorimetry:

| | |
|---|---|
| without additive | 55 mg Ag/m² |
| 2.5 g/liter of the compound of the formula (109) | 0 |

What is claimed is:

1. A method for processing imogeuise exposed silver dye-bleach materials, with the process measures (1) silver developing, (2) dye bleaching, (3) silver bleaching and (4) fixing, optionally process measure (3) can be combined with process measure (2) in a single treatment step, which method comprises employing for the silver bleaching (3) or the combined dye (2) and silver bleaching (3) an acid formulation which has a pH value of at most 2 and contains (a) a strong acid, (b) a water-soluble iodide, (c) optionally a water-soluble organic nitro compound, (d) a non-quaternised quinoxaline or pyrazine, (e) an anti-oxidant and (f) at least one quaternary ammonium salt of the formulae

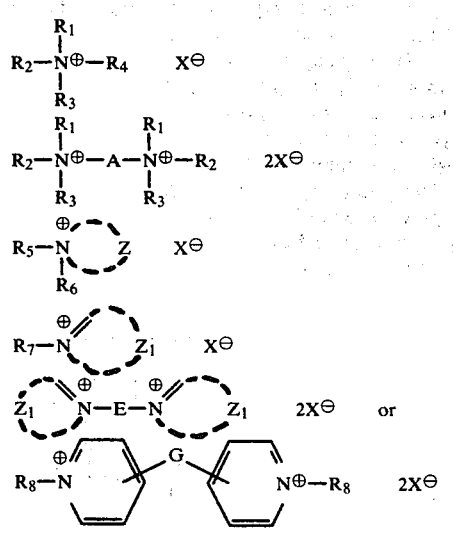

or a protonated tertiary organic nitrogen base of the formula

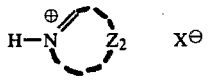

in which formulae $R_1$, $R_2$, $R_3$, $R_4$ and $R_5$ independently of one another are methyl or ethyl, $R_6$ is methyl or ethyl to a further quaternary nitrogen atom of Z, Z is $-(CH_2)_5-$ or $$-(CH_2)_2\overset{|}{\underset{|}{N}}{}^{\oplus}-(CH_2)_2-,$$

$R_7$ is alkyl having 1 to 4 carbon atoms, unsubstituted or substituted aryl or hydroxyalkyl having 1 to 20 carbon atoms and $R_8$ is methyl or ethyl, or the two $R_8$'s together are alkylene having 2 to 4 carbon atoms if G is a direct bond, G is a direct bond or alkylene having 1 to 20 carbon atoms, $Z_1$ is the atoms necessary to form a pyridine, pyrazine or quinoline ring, which is unsubstituted or substituted by methyl, ethyl or hydroxyalkyl having 1 to 12 carbon atoms, and $Z_2$ is the atoms necessary to form a pyridine or quinoline ring, which is unsubstituted or substituted by methyl, ethyl or hydroxyalkyl having 1 to 12 carbon atoms, A and E are alkylene having 1 to 20 carbon atoms and $X^{\ominus}$ is a monovalent anion.

2. A method according to claim 1, wherein the strong acid is sulphuric acid or sulphamic acid.

3. A method according to claim 1, wherein the water-soluble iodide is sodium iodide or potassium iodide.

4. A method according to claim 1, wherein the water-soluble organic oxidising agent is a water-soluble aromatic nitro compound.

5. A method according to claim 4, wherein the water-soluble organic nitro compound is mono- or di-nitrobenzenesulphonic acid or one of their water-soluble salts.

6. A method according to claim 5, wherein the nitro compound is o- or m-nitrobenzenesulphonic acid.

7. A method according to claim 1, wherein the non-quarternised pyrazine or quinoxaline has an absorption maximum of less than 450 nm.

8. A method according to claim 7, wherein the quinoxaline is a substituted quinoxaline which contains (a) A hydroxymethyl group in the 2-position and in the 3-position and, as further substituents, 6-methoxy, 6,7-dimethoxy, 6-methoxy-7-acetylamino, [4,5-g]-1,3-dioxolo or [2,3-g]-1,4-dioxano, (b) An acylated hydroxymethyl group in the 2-position and in the 3-position and, as further substituents, 6,7-dimethoxy, 6-methoxy-7-acetylamino, 5-methoxy-6-chloro, 6-methoxy-5-chloro or [4,5-g]-1,3-dioxolo or [2,3-g]-1,4-dioxano, (c) A methyl group in the 2-position and in the 3-position and no further substituents or, as further substituents: monomethoxy or dimethoxy, methyl, 6-chloro, 5-hydroxy or 5,8-dihydroxy, 6-hydroxy, [4,5-f]-1,3-dioxolo or [2,3-g]-1,4-dioxano or (d) A phenyl group in the 2-position and in the 3-position and a sulphonic acid group in the 6-position.

9. A method according to claim 8, wherein the quinoxaline contains (a) A hydroxymethyl group in the 2-position and in the 3-position and, as further substituents, 6-methoxy, 6,7-dimethoxy, [4,5-g]-1,3-dioxolo or [2,3-g]-1,4-dioxano, (b) An acylated hydroxymethyl group in the 2-position and in the 3-position and a methoxy group in the 6-position and in the 7-position, or (c) A methyl group in the 2-position and in the 3-position and no further substituents or, as further substituents: methyl, 6-hydroxy or 5,8-dihydroxy.

10. A method according to claim 1, wherein the anti-oxidant is a reductone or a water-soluble mercapto compound.

11. A method according to claim 10, wherein the anti-oxidant is a compound of the formula HS—A-(—B)$_m$, in which A is an aliphatic, cycloaliphatic, araliphatic, aromatic or heterocyclic bridge member, B is a radical conferring solubility in water and m is an integer of at most 4.

12. A method according to claim 11, wherein the anti-oxidant is a compound of the formula $HS(CH_2)_mCOOH$, in which m is 3 or 4.

13. A method according to claim 1, wherein the quaternary ammonium salt is a compound of the formulae

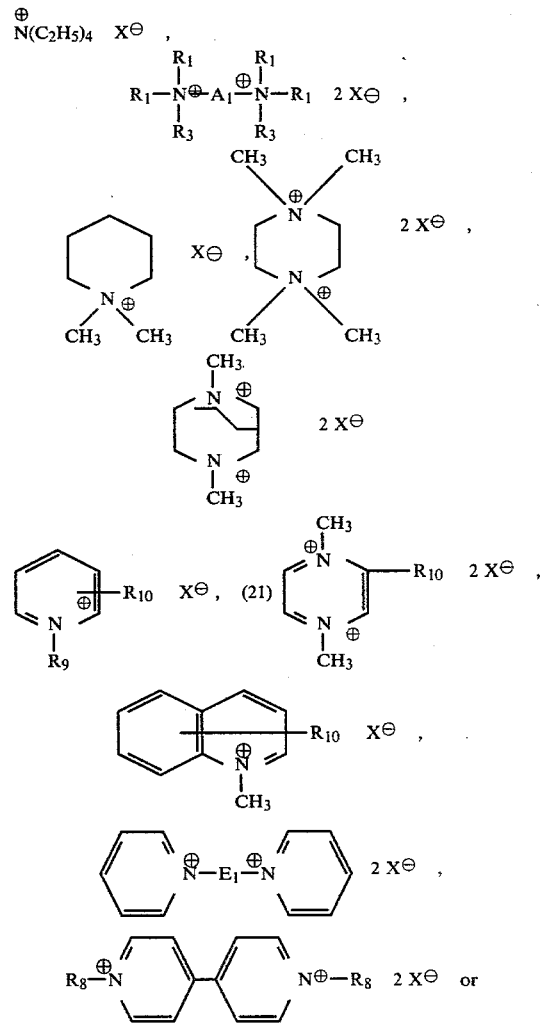

-continued

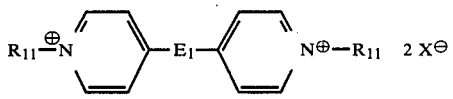

and the protonated tertiary nitrogen base is a compound of the formula

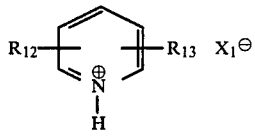

in which formulae $R_1$ and $R_3$ are methyl or ethyl, $R_8$ is methyl or ethyl, or the two $R_8$'s together are $-(CH_2)_n-$, in which n is 2 to 4, $R_9$ is methyl, ethyl, substituted or unsubstituted aryl or ω-hydroxy-alkyl having 1 to 12 carbon atoms, $R_{10}$ is hydroxygen, methyl, ethyl, hydroxymethyl or hydroxyethyl, $R_{11}$ is methyl or ethyl, $R_{12}$ and $R_{13}$ are hydrogen, methyl, ethyl or hydroxyalkyl having 1 to 12 carbon atoms, $A_1$ and $E_1$ are alkylene having 2 to 12 carbon atoms and $X^{\ominus}$ and $X_1^{\ominus}$ are a monovalent anion.

14. A method according to claim 13, wherein the quaternary ammonium salt is a compound of the formula

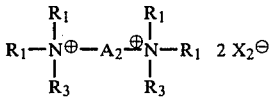

in which $A_2$ is alkylene having 2 to 6 carbon atoms. $R_1$ and $R_3$ are methyl or ethyl and $X_2^{\ominus}$ is a chloride, bromide or iodide ion.

15. A method according to claim 13, wherein the quaternary ammonium salt is a compound of the formulae

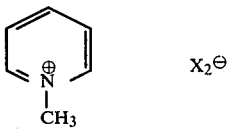

-continued

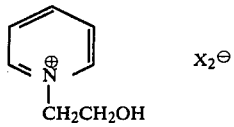

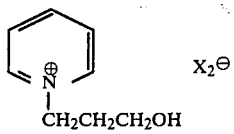

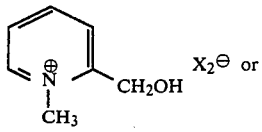

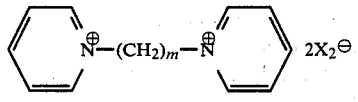

in which $X_2$ is a chloride, bromide or iodide ion and m is an integer from 2 to 12.

16. A method according to claim 13, wherein $X^{\ominus}$ and $X_1^{\ominus}$ are a chloride, bromide, iodide, tetrafluoborate, hydrogen sulphate, toluenesulphonate or fluorosulphate ion.

17. Method according to claim 1, wherein the formulation for the silver-bleaching or for the combined dye-bleaching and silver-bleaching has a pH value of at most 1.

18. A formulation for carrying out the silver-bleaching or the combined dye-bleaching and silver-bleaching by the method according to claim 1, which contains (a) a strong acid which produces a pH value of at most 2 in the formulation, (b) 2 to 50 g/l of a water-soluble iodide, (c) optionally 1 and 30 g/l of a water-soluble organic nitro compound, (d) 0.2 to 5 g/l of a non-quaternised quinoxaline or pyrazine, (e) 0.5 to 10 g/l of an antioxidant and (f) 0.5 to 30 g/l of the quaternary ammonium salt or of a protonated tertiary organic nitrogen base.

19. A formulation according to claim 18, which is prepared from a concentrate which contains components (a) and optionally, (c) and a concentrate which contains components (b), (d), (e) and (f), by dilution with water, which can be mixed with organic solvents.

20. A formulation according to claim 18, which is in the form of separate liquid, especially aqueous, concentrates which contain the components (a) and optionally, (c) and the components (b), (d), (e) and (f).

21. A formulation according to claim 18, which is in the form of a concentrate in liquid or paste form and contains components (a) to (f) in amounts per liter of concentrated formulation which are 4 to 25 times the amounts indicated in claim 18.

* * * * *